US006389258B2

(12) United States Patent
Tano

(10) Patent No.: US 6,389,258 B2
(45) Date of Patent: May 14, 2002

(54) DEVELOPMENT ROLLER AND BLADE USED IN DEVELOPMENT DEVICE, AND DEVELOPMENT DEVICE AND IMAGE-FORMING DEVICE HAVING THE DEVELOPMENT ROLLER AND BLADE

(75) Inventor: Atsushi Tano, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/738,745

(22) Filed: Dec. 18, 2000

(30) Foreign Application Priority Data

May 29, 2000 (JP) ..... 2000-158256

(51) Int. Cl.[7] ..... G03G 15/08
(52) U.S. Cl. ..... 399/286; 399/284
(58) Field of Search ..... 399/279, 284, 399/286, 265, 274; 118/261; 492/18, 49, 53, 56

(56) References Cited

U.S. PATENT DOCUMENTS

| | | | | | |
|---|---|---|---|---|---|
| 4,827,868 | A | * | 5/1989 | Tarumi et al. | 399/286 |
| 5,136,335 | A | * | 8/1992 | Takeda et al. | 399/286 |
| 5,142,330 | A | * | 8/1992 | Hirano et al. | 399/284 |
| 5,162,608 | A | | 11/1992 | Matsuda et al. | 399/270 |
| 5,168,312 | A | * | 12/1992 | Aoto et al. | 399/284 |
| 5,324,885 | A | * | 6/1994 | Koga et al. | 399/279 |
| 5,768,670 | A | * | 6/1998 | Enomoto et al. | 399/284 |
| 5,895,150 | A | * | 4/1999 | Watabe et al. | 399/284 |

FOREIGN PATENT DOCUMENTS

| | | |
|---|---|---|
| JP | 1-207771 | 8/1989 |
| JP | 3-296783 | 12/1991 |
| JP | 06-289703 | * 10/1994 |
| JP | 07-319287 | * 12/1995 |
| JP | 8-44191 | 2/1996 |
| JP | 11-2954 | 1/1999 |
| JP | 11-327284 | * 11/1999 |

* cited by examiner

*Primary Examiner*—Sophia S. Chen
(74) *Attorney, Agent, or Firm*—Armstrong, Westerman & Hattori, LLP

(57) ABSTRACT

It is an exemplified object of the present invention to provide a development device, development roller and blade used in the development device, and development roller and image-forming device having the development roller and blade, which can form a high-quality image in a cost-efficient manner. To achieve this object, the inventive development roller includes a shaft, a base material that coats a periphery of the shaft, and is made of a resistance body, and a layered coating provided on a periphery of the base material, where the layered coating includes two or more layers, a coating layer provided inside an outermost coating layer has a higher charging capability to a developing agent than at least the outermost coating layer.

12 Claims, 3 Drawing Sheets

DEVELOPMENT ROLLER AND BLADE USED IN DEVELOPMENT DEVICE, AND DEVELOPMENT DEVICE AND IMAGE-FORMING DEVICE HAVING THE DEVELOPMENT ROLLER AND BLADE

BACKGROUND OF THE INVENTION

The present invention relates generally to image-forming devices, and more particularly to a development device for use with the electrophotographic image-forming device. The present invention is suitable, for example, for a development device (including a development roller, a blade, and a reset roller) using a nonmagnetic monocomponent developing agent, and an electrophotographic image-forming device having the development device. However, it is to be understood that the scope of application of the present invention is not limited to devices using the nonmagnetic monocomponent developing agent.

The "nonmagnetic monocomponent developing agent" is a single component developing agent that is not magnetized and includes no carrier. The "electrophotographic image-forming device" is an image-forming device employing the Carlson process described in U.S. Pat. No. 2,297,691, as typified by a laser printer, and denotes a nonimpact printer that provides recording by depositing a developing agent as a recording material on a recordable medium (e.g., printing paper, and OHP film).

With the recent development of office automation, the use of electrophotographic image-forming devices such as a laser printer for computer's output devices, facsimile units, photocopiers, etc. has spread steadily. Particularly, an electrophotographic printer as an example of the electrophotographic image-forming devices features good operability, usability for a wide range of media, high cost efficiency, and high printing quality, whereby a further improvement in high-quality and high-speed printability will be expected in future. The electrophotographic image-forming device generally includes a photoconductive insulator (photosensitive drum), and follows the procedural steps of charging, exposure to light, development, transfer, fixing, and other post-processes.

The charging step uniformly electrifies the photosensitive drum (e.g., at −780V). The exposure step irradiates a laser beam or the like on the photosensitive drum, and changes the electrical potential at the irradiated area down, for example, to −60 V or so, forming an electrostatic latent image. The development step electrically deposits a developing agent onto the photosensitive drum using, for example, the reversal process, and visualizes the electrostatic latent image. The reversal process is a development method that forms an electric field by a development bias in areas where electric charge is eliminated by exposure to light, and deposits the developing agent having the same polarity as uniformly charged areas on the photosensitive drum by the electric field. The transfer step forms a toner image corresponding to the electrostatic latent image on a recordable medium. The fixing step fuses and fixes the toner image on the medium using heat, pressure or the like, thereby obtaining a printed output. The post-processes may include charge neutralization and cleaning on the photosensitive drum from which toner has been transferred out, a collection and recycle and/or disposal of residual toner, etc.

The developing agent for use with the aforementioned development step can be broadly divided into a monocomponent developing agent using toner and a dual-component developing agent using toner and a carrier. The toner may include a particle prepared, for example, in such a manner that a colorant such as a dye and a carbon black, or the like is dispersed in a binder resin made of synthetic macromolecular compound, and then is ground into a fine powder of approximately 3 through 15 μm. A usable carrier may include, for example, an iron powder or ferrite bead of approximately 100 μm in diameter. The monocomponent developing agent advantageously results in: (1) simple and miniature equipment of the development device due to eliminating a carrier deterioration, a toner density control, mixing, and agitation mechanisms; and (2) no residual waste such as a carrier in used toner.

The monocomponent developing agent may be further classified into a magnetic monocomponent developing agent that includes a magnetic powder in toner, and a nonmagnetic monocomponent developing agent that does not include the same. However, the magnetic monocomponent developing agent is disadvantageous in: (1) the low transfer performance due to the high content of low electrically resistant magnetic powder which hinders the increased electric charge amount; (2) the bad colorization due to its low transparent, black-color magnetic powder; (3) the low fixing performance due to the magnetic powder which requires high temperature and/or high pressure, increasing a running cost. Accordingly, the nonmagnetic monocomponent developing agent without these disadvantages is expected to be in increasing demand in future.

The nonmagnetic monocomponent developing agent commonly includes the toner having a relatively high volume resistivity (e.g., at 300 GΩ·cm, etc.). In addition, the toner, as basically carries no electric charge, needs to be charged by the triboelectrificity or charge injection in the development device.

The development process employing the nonmagnetic monocomponent developing agent is divided into contact- and noncontact-type development processes: the contact-type development process that deposits a developing agent on the photosensitive drum by bringing the development roller carrying the developing agent into contact with the photosensitive drum; and the noncontact-type development process that provides a certain gap (e.g., of about 350 μm) between the development roller and the photosensitive drum to space them from each other, and flies the developing agent from the development roller to and deposits the same onto the photosensitive drum.

It is significant for the noncontact-type development process employing the nonmagnetic monocomponent developing agent to ensure a sufficient image density by controlling the amount of toner conveyed from the development roller to the photosensitive drum. Thus, it is very important to form a specified toner layer while controlling its thickness on the development roller. As a typical method for regulating a toner layer thickness, it has conventionally been proposed to provide a blade (restriction blade) in contact with the development roller to maintain the layer thickness uniform.

The noncontact-type development device employing the nonmagnetic monocomponent developing agent comprises a toner tank, an agitation paddle, a development roller, a reset roller, and a blade. The toner tank is configured to store toner required for printing, and to supply toner to the reset roller. The agitation paddle is provided in the toner tank, and serves to prevent the toner from agglomerating and coagulating by agitating the toner. The development roller adsorbs onto a surface thereof charged toner in the form of a thin layer, and conveys the toner to a development area in contact with the photosensitive drum. The development roller is connected with a bias power supply that applies a development bias. The reset roller, which is also called supply roller or application roller, contacts the development roller and supplies toner to the development roller. Further a reset bias is applied to the reset roller. The reset roller also serves to scrape off and remove the toner unused for the development and remaining on the development roller, and to collect the same to the toner tank for recycling.

The blade is brought into contact with the development roller, and serves to regulate the toner layer to a uniform thickness. A blade bias is applied to the blade, making the charge injection into toner possible. A toner layer on the development roller, if too thin, would result in a low and uneven image density, while, if too thick, would increase a proportion of oppositely charged or low charged toner, thereby producing a fog in a no-image area (i.e., undesirably coloring with the toner an area which has no image and is therefore expected to be white clarity). Thus, the blade is required to form a toner layer having an appropriate thickness.

In development operation, the toner is charged (e.g., negatively) through sliding friction among the reset roller, the blade, and the development roller. The negatively charged toner is thereafter fed onto a surface of the development roller by the reset roller, and deposited thereon by electrostatic adsorption. Subsequently, the toner layer on the development roller is leveled using the blade to form a thin layer having a uniform thickness of about 10 $\mu$m. The toner, which has been conveyed to a development area, gets adhered to an electrostatic latent image on the photosensitive drum with the electrical force of attraction using a predetermined voltage applied to the development area. Consequently, the latent image is visualized and developed. Next, the residual toner unused for the development is scraped off and removed by the reset roller from the development roller, and collected into the toner tank. The development process repeats a series of these operations.

In the above-described development process, the toner is stressed in various ways, which produces deterioration of the toner. The toner deterioration means a deterioration in a surface condition due to separation or embedment of external additives for adding charge and fluidity, and, in addition, an increase of powdered toner due to pulverization of the toner. In the development operation, the toner is stressed by: (1) the sliding friction among the reset roller, the blade, and the development roller; (2) the contact with the photosensitive drum and the development roller; and (1) the agitation stress in the toner tank caused by the agitation paddle. Particularly, a large proportion of the residual toner unused for the development and left on the development roller includes such deteriorated toner, and repeated use of the toner for printing would further impose the stress on the same toner, whereby the deterioration of the toner progresses steadily. The deterioration of the toner may be proved, for example, by measuring a lowered fluidity and increased proportion of powered toner.

As the deterioration of the toner progresses, a charging property of the toner lowers. This would resultantly increase a proportion of low charged or oppositely charged toner in the toner for use in the development, and increase susceptibility to fogging in the no-image area. Therefore, it has been conventionally proposed to provide a method of preventing the charging property of the toner from lowering by injecting charge from outside into the low charged toner in order to repress or reduce fogging. It has also been proposed to provide a method of avoiding reverse charge injection into toner in contact with the development roller by setting electrical resistance of the development roller at a substantially high level, thereby preventing the low charged or oppositely charged toner from being produced.

However, the conventional method of repressing disadvantageous fogging in the contact-type development process using a nonmagnetic monocomponent developing agent has detrimental effects such as lowering development efficiency and producing image retention in an early stage of printing. Particularly, if the resistance of the development roller were set at $10^{10}\Omega$ or higher, charges would accumulate on a surface of the development roller, and vary the development voltage, thereby producing a fog and lowering the development efficiency. The image retention is a phenomenon in which the image density partially varies under the influence of an image previously printed.

The development efficiency lowers, because a charge amount of toner increases, and a total charge amount of the toner layer becomes higher than the total charge amount (Q=CV) estimated utilizing a voltage applied when a photosensitive drum-toner layer-development roller relationship is deemed to work as a capacitor. In this case, the toner on the development roller would not be sufficiently utilized for the development, lowering the image density.

In the aforementioned development operation, part of the toner on the development roller corresponding to an image is adsorbed onto the photosensitive drum, and the other part of the toner corresponding to a no-image area is left on the development roller. The development device is configured to flake off such residual toner from the development roller by the reset roller, but actually, fails to remove a considerable amount of the toner, which is conveyed to and brought into contact with the blade once again, thereby requiring further charge injection. Accordingly, the charge amount of the toner increases, and the toner gets adhered more strongly onto the development roller by an image force. Moreover, high charged toner having a small particle diameter tends to be adhered selectively onto the no-image area on the development roller, because powdered toner has so high mechanical adherence that the reset roller cannot easily flake off the same. Thus, variation in the particle diameter and charge amount may disadvantageously result between the toner layer adhered onto an area on which toner was deposited in the next previous printing cycle and that adhered onto no-image area on which no toner was deposited then. Consequently, a high-density image may be formed in an area corresponding to the toner-deposited area on an immediately preceding printed page, while a low-density image may be formed in an area corresponding to the no-image area on an immediately preceding printed page. This phenomenon is called positive image retention. Particularly, the image retention is caused by an increase of the toner charge amount, and thus frequently produced when the toner is substantially high charged, as in a low-humidity environment or in an early stage of printing.

In order to repress the occurrence of the image retention, it may be a conceivable measure to add a neutralizing means for eliminating charge in residual (undeveloped) toner on the development roller. However, this measure would require an additional instrument provided in the development device, and disadvantageously increase the complexity and costs of the device.

Moreover, the resistance of the development roller set at $10^5\Omega$ or lower could serve to repress the occurrence of the positive image retention in an early stage of printing, but if the device were operated in a high-humidity environment, and the toner were deteriorated, the charge would be injected from the development roller to the toner, and make a fog liable to be produced.

Further, as a means for repressing both of the positive image retention and fogging, it may be a conceivable measure to adjust voltages applied to the development roller and reset roller according to the deterioration of the toner due to repeated printing operations. To be more specific, this measure facilitates collecting the toner on the development roller by shifting a voltage difference applied to the development roller and the reset roller into preferable polarity for collecting with respect to toner charging polarity. This measure would improve a toner collecting capability of the reset roller, and thus reduce the occurrence of the positive image retention. However, this measure would reduce a toner supply to the development roller by the reset roller, and make the reset roller likely to collect the toner having a high charge amount, thereby disadvantageously making the device liable to produce negative image retention. In addition, in order to adjust and control the applied voltages in such a manner, a complicated power unit or sequencer need be provided, leading to an increase in costs.

BRIEF SUMMARY OF THE INVENTION

Accordingly, it is an exemplified general object of the present invention to provide a novel and useful development roller and blade used in a development device, development device and image-forming device having the development roller and the blade, in which one or more of the above-described conventional disadvantages are eliminated.

Another exemplified and more specific object of the present invention is to provide a development roller and blade used in a development device, and development device and image-forming device having the development roller and the blade that may cost-efficiently form a high-quality image.

In order to achieve the above objects, the development roller as one exemplified embodiment of the present invention comprises a shaft, a base material that coats a periphery of the shaft, and is made of a resistance body, and a layered coating provided on a periphery of the base material, wherein the layered coating includes two or more layers, and a coating layer provided inside an outermost coating layer has a higher charging capability to a developing agent than at least the outermost coating layer. According to the development roller, even if repeated printing operations scraped away the outermost coating layer and deteriorated toner, the coating layer provided inside with a higher charging capability than the outermost coating layer would be exposed, and thus could prevent the charging capability of toner from lowering.

The blade as one exemplified embodiment of the present invention comprises a base material made of metal and shaped like a plate, and a layered coating provided on one surface of the base material, the surface being in contact with a development roller, wherein the layered coating includes two or more layers, and a coating layer provided at least inside an outermost coating layer has a higher charging capability to a developing agent than the outermost coating layer. This blade has a layer structure similar to the above development roller, and thus can prevent the charging capability of toner from lowering due to repeated printing operations.

The development device as one exemplified embodiment of the present invention comprises a development roller, and a blade that is brought into contact with the development roller, and forms a toner layer at a predetermined layer thickness, wherein the development roller comprises a shaft, a base material that coats a periphery of the shaft, and is made of a resistance body, and, a layered coating provided on a periphery of the base material, wherein the layered coating includes two or more layers, and a coating layer provided at least inside an outermost coating layer has a higher charging capability to a developing agent than the outermost coating layer. This development device includes the above development roller, and thus can prevent the charging capability of toner from lowering due to repeated printing operations. Accordingly, fogging due to the repeated printing operations may be prevented. In addition, in an early stage of a printing process, low charging capability to the toner is provided, and thus an upsurge in toner charge amount beyond the amount as deemed necessary can be restricted, and image retention may also be prevented.

The development device as another exemplified embodiment of the present invention comprises a development roller, and a blade that is brought into contact with the development roller, and forms a toner layer at a predetermined layer thickness, wherein the blade comprises a base material made of metal and shaped like a plate, and a layered coating provided on one surface of the base material, the surface being in contact with a development roller, wherein the layered coating includes two or more layers, and a coating layer provided at least inside an outermost coating layer has a higher charging capability to a developing agent than the outermost coating layer. The development device includes the above blade, and thus can prevent the charging capability of toner from lowering due to repeated printing operations. Accordingly, fogging due to the repeated printing operations may be prevented. In addition, in an early stage of a printing process, low charging capability to the toner is provided, and thus an upsurge in toner charge amount beyond the amount as deemed necessary can be restricted, and image retention may also be prevented.

The image-forming device as one exemplified embodiment of the present invention comprises a photosensitive body, a charger that charges the photosensitive body, an exposure section that exposes the photosensitive body charged by the charger to light, and forms an electrostatic latent image, a development device that develops the photosensitive body exposed to light, and visualizes the electrostatic latent image into a toner image, and a transfer section that transfers the toner image onto a recordable medium, wherein the development device comprises a development roller and a blade that is brought into contact with the development roller, and forms a toner layer at a predetermined layer thickness, wherein the development roller comprises a shaft, a base material that coats a periphery of the shaft, and is made of a resistance body, and a layered coating provided on a periphery of the base material, wherein the layered coating includes two or more layers, and a coating layer provided at least inside an outermost coating layer has a higher charging capability to a developing agent than the outermost coating layer. The image-forming device includes the above development device, and thus has an operation similar to the development device.

Other objects and further features of the present invention will become readily apparent from the following description of the embodiments with reference to accompanying drawings.

DETAILED DESCRIPTION OF THE INVENTION

Figure 1:
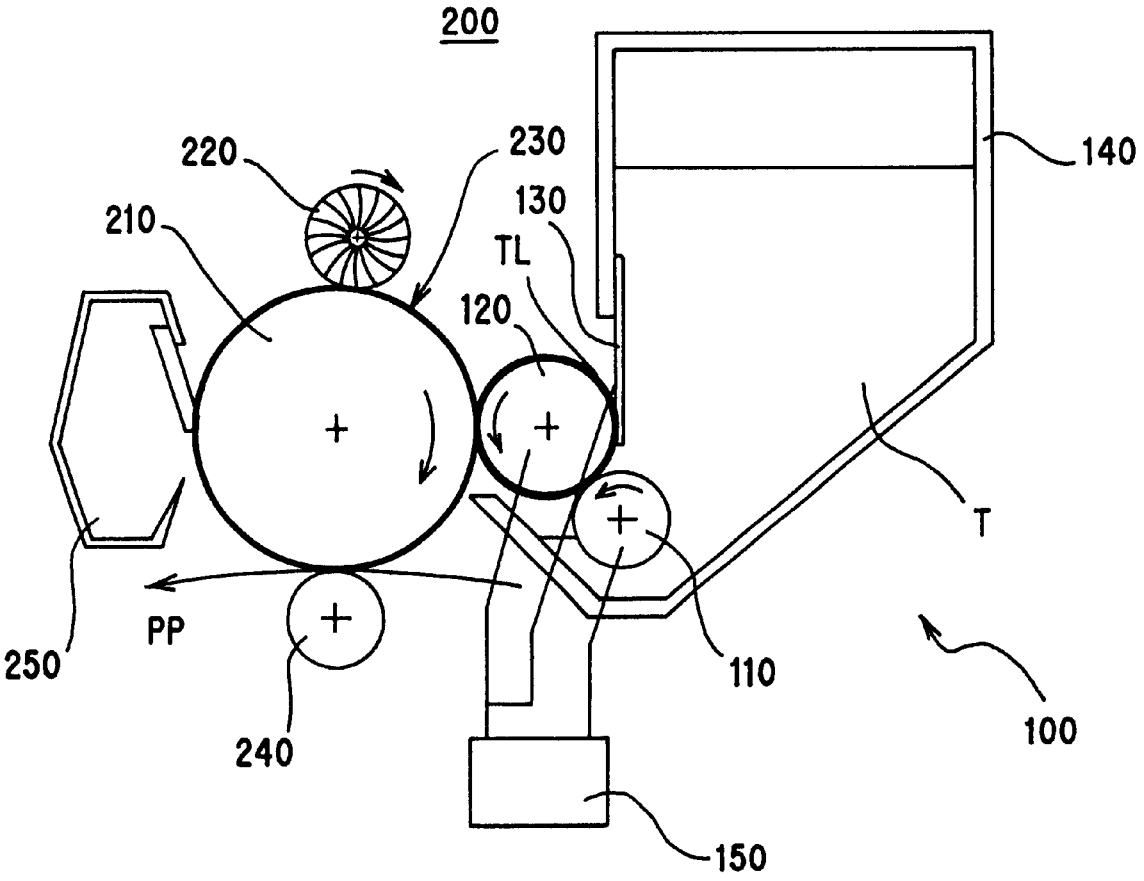
FIG. 1 is a schematic sectional view of a principal part of an image-forming device including a development device as one exemplified embodiment of the present invention.

A description will now be given of a development device 100 and an image-forming device 200 having the development device 100 with reference to FIGS. 1 to 4 inclusive. In each figure, those elements designated by the same reference numerals denote the same elements, and a duplicate description thereof will be omitted. Hereupon, FIG. 1 is a schematic sectional view of a principal part of the image-forming device 200 including the development device 100. As shown in FIG. 1, the development device 100 includes a reset roller 110, a development roller 120, a (doctor) blade 130, a toner tank 140, and a development bias power supply 150. The image-forming device 200 includes a development device 100, a photosensitive drum 210, a pre-charger 220, an exposure section 230, and a transfer roller 240.

The reset roller 110, which is also called a supply roller or application roller, supplies toner T from the toner tank 140 to the development roller 120. The reset roller 110 is configured to electrify the toner T by friction between the development roller 120 and the reset roller 110, and thus made of an electrically conductive material such as sponge. In the present embodiment as shown in FIG. 1, the reset roller 110 rotates to the left (counterclockwise), and is brought into contact with the development roller 120. Utilizing this contact and rotation, the toner T is supplied to the development roller 120. The reset roller 110 may also serve to collect the residual toner T unused for the development and left on the development roller 120. When the toner T is collected, the toner T is scraped off from a surface of the development roller 120 utilizing the contact of the both rollers 110 and 120, and returned into the toner tank 140.

Figure 2:
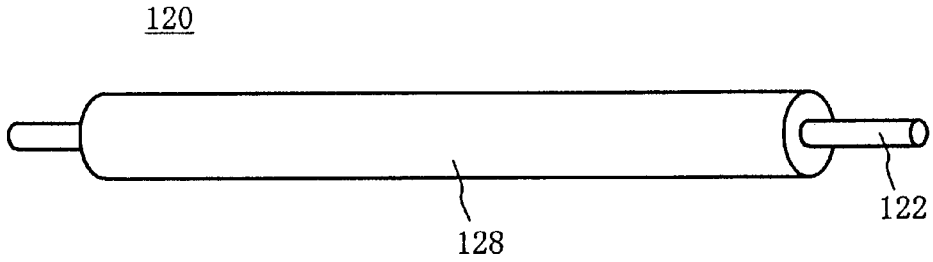
FIG. 2 is a schematic perspective view for showing an outward appearance of development roller.
Figure 3:
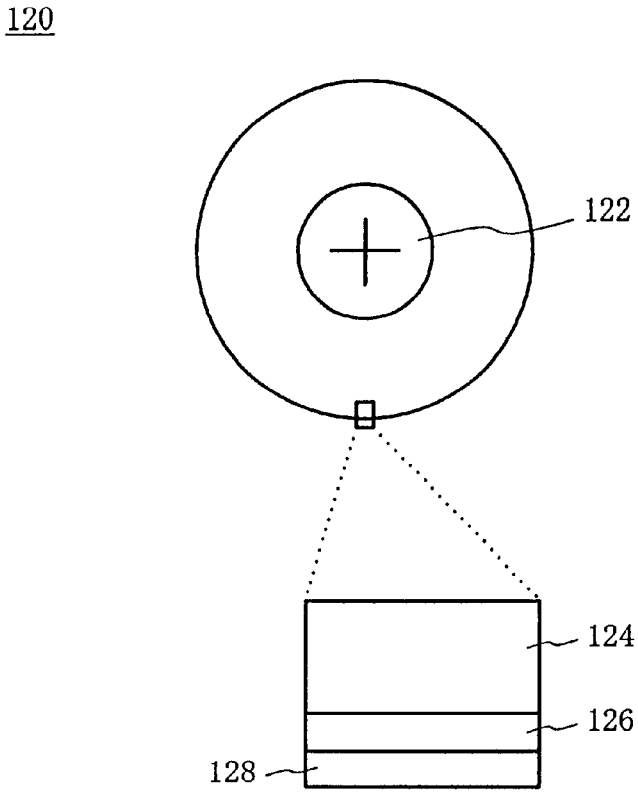
FIG. 3 is a schematic sectional view for explaining a structure of the development roller shown in FIG. 2.

The development roller 120 adsorbs the toner T onto the surface thereof, and, as rotating, conveys the toner T to a surface of the photosensitive drum 210, which will be described later, in contact with the development roller 120. The development roller 120, for instance, rotates at a circumferential velocity 1.5 times faster than the photosensitive drum 210, in the same direction as the photosensitive drum 210. Referring to FIGS. 2 and 3, the development roller 120 includes a shaft 122, a base material 124, a first coating layer 126, and a second coating layer 128. FIG. 2 is a schematic perspective view for showing an outward appearance of the development roller 120, FIG. 3 is a schematic sectional view for explaining a structure of the development roller 120 shown in FIG. 2.

The shaft 122 is a member serving as an axis of rotation of the development roller 120, and the base material 124, the first coating layer 126, and the second coating layer 128 are layered in this sequence on a periphery of the shaft 122. The shaft 122 is made, for example, of a stainless steel member. The base material 124 coats a periphery of the shaft 122. The base material 124 is made up of an elastic body such as solid rubber (nitrile rubber or NBR) and urethane rubber. In experiments, polyurethane rubber having a hardness of 50 on JIS-A scale with resistance between the shaft 124 and the base material 122 adjusted to approximately $10^5\Omega$ was used as the base material 122.

The first coating layer 126 and the second coating layer 128 are used as coating materials for the surface of the development roller 120, and as shown in FIG. 2, a surface of the first coating layer 126 is coated with the second coating layer. In other words, the second coating layer 128 forms an outmost layer of the development roller 120, and contacts the photosensitive drum 210. Layer thicknesses of the coating layers 126 and 128 were experimentally worked out from amounts of coating layers scraped through printing operations: the first coating layer 126 was set at 5–20 $\mu$m; and the second coating layer 128 was set at 1–5 $\mu$m. Materials of the coating layers 126 and 128 are, for example, metamorphic silicon, or urethane resin, and thus charging capability of the first coating layer 126 is higher than that of the second coating layer 128. Further, in order to prevent the accumulation of charges, the coating layers 126 and 128 are configured to have carbon mixed and dispersed therein to constitute 0 thorough 5% thereof, and are adjusted so as to bear electrical charges of approximately $10^8\Omega$.

The inventive development roller 120 has a two-tier structure including the coating layers 126 and 128, and these coating layers 126 and 128 are different in charging capability from each other. Therefore, even if the toner T has been repeatedly used and has now lowered charge amount, the second coating layer 128 is worn and scraped away by the contact with the photosensitive drum 210, and thus the first coating layer 126 having higher charging capability appears so as to add higher charges to the toner T, providing a supplement to the reduced charges in the toner T. In short, a higher potential is added to the toner T that has been low in charge amount, and thereby the charge amount of the toner T can be made stable regardless of the use status. This resultantly may prevent a fog from occurring due to the deterioration of the toner T, and form a high-quality image. The materials and properties of the first coating layer 126 and the second coating layer 128 will be described in details when preferred embodiments of the present invention is described below.

An experiment was carried out for the present embodiment in which the reset roller 110 was brought into contact with the development roller 120 at the contact depth of 0.05 mm, and the both rollers were rotated to the left. Accordingly, the reset roller 110 and the development roller 120 were rotated opposite in direction to each other at their contact point. The rotation speed of both the reset roller 110 and the development roller 120 were adjusted to the same speed (90 mm/s).

The blade 130 is a member serving to restrict to a predetermined thickness the toner T supplied by the reset roller 110. The blade 130 also serves to charge the toner T by sandwiching the toner T between the blade 130 and the development roller 120 and applying friction to the toner T conveyed by the development roller 120. In addition, a potential may be applied to the blade 130, and charges may be injected into the toner T through the blade 130. This blade 130 may be made of a variety of materials such as an elastic body typified by urethane, etc., and metal having leaf spring properties such as stainless steel and phosphor bronze. In the present embodiment, as shown in FIG. 1, the blade 130 adopts a midsection contact method in which a midsection of the blade 130 may be brought into contact with the development roller 120 at a predetermined line pressure, and the blade 130 is engaged in the development roller 120 to restrict the layer thickness of the toner T.

Figure 4:
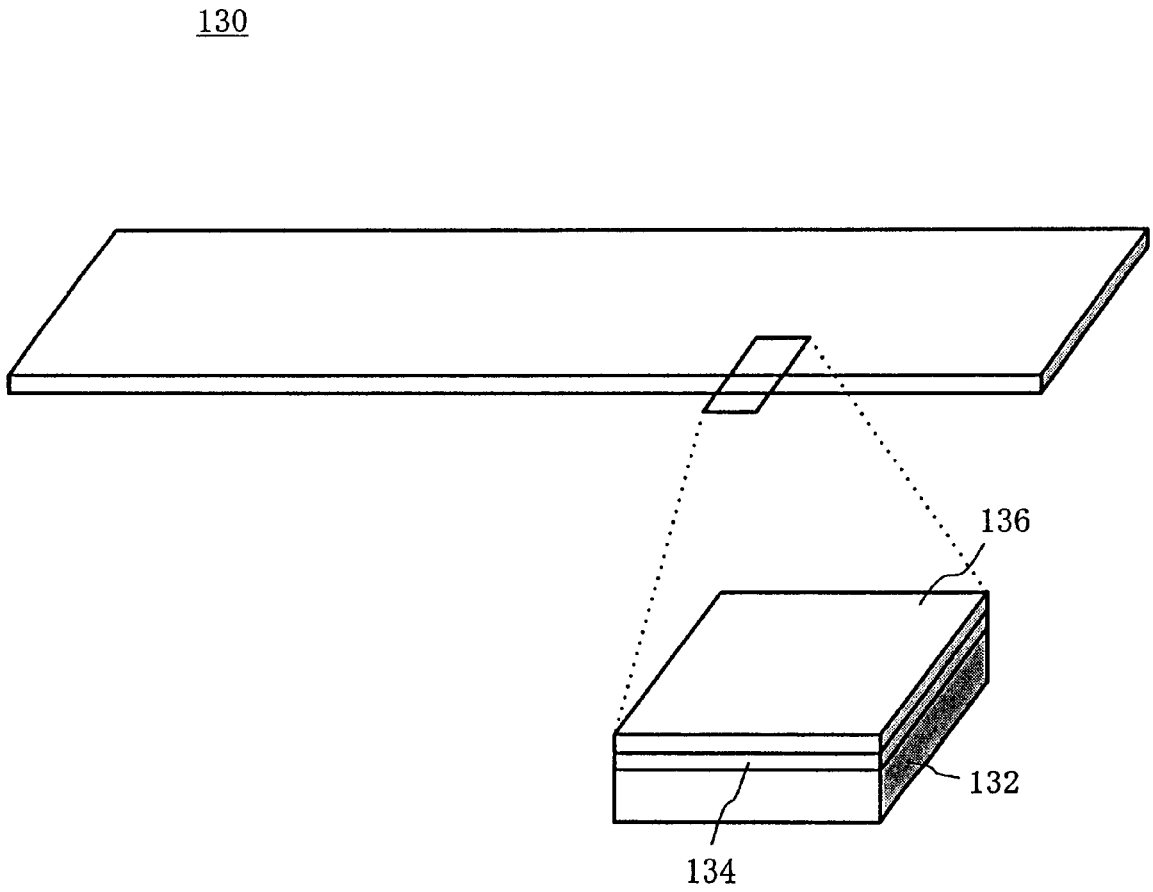
FIG. 4 is a schematic sectional view for explaining a structure of a blade.

The blade 130 in the present invention has a layered structure as shown in FIG. 4. Referring to FIG. 4, the blade 130 includes a blade base material 132, a first coating layer 134, and a second coating layer 136. FIG. 4 is a schematic sectional view for explaining the structure of the blade 130.

The blade base material 132 is shaped like a plate, and a surface thereof in contact with the toner T is layered with the first coating layer 134 and the second coating layer 136 in this sequence. The first coating layer 134 and the second coating layer 136 coat the surface of the blade 130, and work in such a manner as the coating layers 126 and 128. Specifically, a charging capability of the coating layer 134 is higher than that of the coating layer 136. Therefore, even if the toner T has been repeatedly used and has now lowered charge amount, a higher potential may be injected into the toner T, and thereby the charge amount of the toner T may be made stable. Carbon or the like may be added also to the coating layers 134 and 136 of the blade 130.

The toner tank 140 stores the toner T, supplies the same to the reset roller 110, and receives the toner T collected by the reset roller 110. The toner tank 140 includes a paddle, an agitator, and other components (not shown), and is connectible with an external toner storage container such as a toner cartridge. In the present embodiment, a bias power supply 150 is. employed as a means for applying a voltage, but another means for generating a voltage using alternating current (AC), or superposed alternating current and direct current (DC) may be employed as well.

Referring again to FIG. 1, a description will be given of the image-forming device 200 as one exemplified embodiment of the present invention. The image-forming device 200, as shown in FIG. 1, includes the above-described development device 100, a photosensitive drum 210, a pre-charger 220, an exposure section 230, a transfer roller 240, and a cleaner 250.

The photosensitive drum 210 includes a photosensitive dielectric layer on a rotatable drum-shaped conductor support, and is uniformly charged by the charger 220. The photosensitive drum 210 is, for instance, made of an OPC to which a function separation-type organic photoreceptor is applied on a drum-shaped aluminum member, and rotates at a circumferential velocity of 72 mm/s in the arrow direction.

The charger 220, which is, for instance, a brush roller charger, uniformly charges a surface of the photosensitive drum 210 (e.g., at about −780V). The superposed AC and DC as an applied voltage may be provided to the charger 220. The exposure section 230 includes as a light source, for example, a semiconductor laser, and uses a laser beam corresponding to an image to expose the photosensitive drum 210 to light. The exposure neutralizes a potential on the charged surface of the photosensitive drum 210 (e.g., to about −60V), and forms a latent image corresponding to image data for the image to be recorded.

The development device 100, which has the above-described structure, supplies fine toner T fed from the toner tank 140 to the photosensitive drum 210, and visualizes the latent image formed in the exposure section into a toner image. The transfer roller 240 generates an electric field that electrostatically adsorbs the toner T, and transfers the toner image adsorbed on the photosensitive drum 210 onto a sheet of printing paper utilizing a transfer current.

A cleaner 250 collects and disposes of the toner T remaining on the photosensitive drum 210 from which the toner T has been transferred out, or returns the collected toner to the toner tank 140, as necessary.

In operation of the image-forming device 200 as shown in FIG. 1, the photosensitive drum 210 is uniformly negatively charged (e.g., at −780V) in the charger 220. When the laser beam is irradiated from the exposure section 230 on the photosensitive drum 210, uniform charge on an area of the photosensitive drum 210 corresponding to the image is eliminated through the exposure to light by the laser beam, whereby a latent image is formed. Thereafter, the latent image is developed in the development device 100.

To illustrate the development operation more specifically, in the development device 100, the development roller 120 engaged in the photosensitive drum 210 at the contact depth of about 50 $\mu$m rotates to the left, and the blade 130 regulates the toner T fed from the reset roller 110, forming a toner layer TL on the development roller 120. The toner layer TL formed in this manner is 8 through 10 $\mu$m, and the amount of deposited toner per unit area is 4 through 7 g/m$^2$. The development device 100 in the present embodiment may stably form a uniformly charged toner layer TL regardless of the number of the development operations, because of the above-described structure of the development roller 120 and the blade 130. The toner T is negatively charged by sliding friction among the reset roller 110, the development roller 120, and the blade 130.

The bias power supply 150 applies a voltage of −450V to the reset roller 110, and −350V to the development roller 120. Similarly a voltage of −350V is applied to the blade 130. Accordingly, the toner T on the development roller 120 has stable charge irrespective of the number of printed sheets, and thus a stable toner layer TL may be formed. Thereafter, the toner T formed as the toner layer TL on the development roller 120 is deposited onto the latent image area on the photosensitive drum 210 using the development bias voltage applied to the development roller 120, and developed. The toner T unused for the development is flaked off with the reset roller 110 rotating below the development roller 120 in an opposite direction, and passing under the reset roller 110, returned to the toner tank 140.

The toner image on the photosensitive drum 210 as obtained in the development device 100 is transferred using the transfer roller 240 onto a sheet of printing paper that is timely conveyed along a paper-conveying path PP by a conveyance roller (not shown). The residual toner T remaining on the photosensitive drum 210 is collected using the cleaner 250. The printing paper that has been printed passes through a fixing section (not shown) to fix the toner thereon, and then is dispensed out.

The toner T was selected from nonmagnetic monocomponent developing agents that are in common use, and prepared, for example, from polyester as a base element by kneading fine carbon particles as a colorant, a charge control agent (CCA) as a charge adjustment agent, and a wax agent made of polypropylene for enhancing fixing property, and pulverized into a predetermined volume average particle diameter. Thereafter, a powder smaller than 3 $\mu$m and coarse particles equal to or larger than 20 $\mu$m were removed, and fine particles of silicon oxide and titanium oxide to provide fluidity and charge were externally added to coat a surface of the remaining particles. This toner T has such thermal characteristics that its glass transition temperature ranges between 55 and 67° C., and its melting point ranges between 120 and 150° C. A large gap between the glass transition temperature and the melting point is due to its broad range of a coating ratio of external additives, a molecular distribution and cross-linking degree of styrene resin. The toner T is obtainable by not using the above-described pulverizing method, but using any preferred method such as a polymerization process, a spray-drying process and other powder-making processes. In the experiment, the toner T is about 8 $\mu$m in volume average particle diameter, and charge polarity thereof is negative.

EXAMPLE

[Experiment 1]

An image-formation experiment 1 was carried out using the image-forming device 200 according to the present invention. The reset roller 110 as used herein was made of silicon foam having resistance of $10^7\Omega$, and engaged in the development roller 120 to the depth of 0.5 mm. The development roller 120 as used herein was a layered body including a base material 124 made of polyurethane rubber having resistance of $10^5\Omega$, and a hardness of about 50, coated with the first and second coating layers 126 and 128, and the diameter thereof was 16 mm. The blade 130 as used herein was electrically conductive body (metal) having a thickness of 0.1 mm, and brought into contact with the development roller under a line pressure of about 30 g/cm. A direct current voltage as the development voltage bias was applied at −450 V to the reset roller 110, at −350 V to the development roller 120, and at −350 V to the blade.

A potential at the surface of the photosensitive drum 210 was −780 V, and a potential at the exposed latent image area was about −60 V. The same experimental conditions as described above were applied in relation to the image-forming operation unless otherwise specified. In the experiment 1, the above conditions were accepted, and materials used for the first coating layer 126 and the second coating layer 128 were altered, and image retention generated in an early stage of printing, and a fog generated after repeated printing operations were measured.

Table 1 represents resins used for the coating layers 126 and 128 in ascending order of positive-charging capabilities, i.e., in a charging series. The toner T as used herein for the present experiment was negatively charged, so that a member having a higher positive-charging capability may be charged negatively to a larger extent.

TABLE 1

| Positive-charging capability order | Materials for coating layers |
|---|---|
| 1 | Silicon |
| 2 | Polyurethane |
| 3 | Polystyrene |
| 4 | Polyvinyl butyral |

Other than those listed in Table 1, polymethylmethacrylate (PMMA), nylon 66 (polyamide), polyester, polyethylene terephthalate (PET), polyethylene, polycarbonate, epoxy resin, or the like may be used, but usable materials are not limited thereto. In the instant experiment 1, the coating layers were formed using a resin to which a charge control agent was not added, and the experiment was carried out.

The resin materials as listed in Table 1 were applied as a coating layer having a thickness of about 20 $\mu$m on the development roller 120, and the amount of each coating layer that was scraped away was measured. The development device 100 was driven to rotate under the same conditions (concerning contact with the photosensitive drum 210 and rotation time) as applied when 20,000 sheets of A4-paper were fed in portrait orientation, and the measurement was carried out. The laser outer diameter measuring instrument manufactured by Keyence Corporation was used to measure a variation of outer diameters (in radius) of the development roller 120. The results are shown in Table 2.

TABLE 2

| Materials for coating layers | Amount scraped away |
|---|---|
| Silicon | 6.5 $\mu$m |
| Polyurethane | 11.4 $\mu$m |
| Polystyrene | 14.5 $\mu$m |
| Polyvinyl butyral | 13.3 $\mu$m |

As shown in Table 2, except for silicon, the other three resins exhibit substantially the same amount of the materials scraped away as one another. These results would be an indicator for selecting the most suitable coating layers 126 and 128 for the development roller 120 to be used.

Next measured were specific toner charges on the development roller 120 when the outermost layer of the development roller 120 was formed with the sole coating layer selected among the resins listed in Table 1. The specific toner charges were calculated by utilizing equations (1) through (6), from a potential of the toner layer TL formed on the development roller 120, which was measured by a noncontact-type surface potential meter (Trek Model 344), and a deposited toner amount per unit area. Then, the development roller 120 in the development device 100 that had printed 10,000 sheets was replaced with a new one that is formed with the coating layer 128 made of each resin material, and a fog generated on the photosensitive drum 210 was picked up, whereby fogging (O. D. value) when the toner was deteriorated was determined. Further, the occurrence of the image retention in an early stage of printing was measured using the development roller formed with the coating layer 128 made of each resin material. The image retention was determined by printing a solidly filled area and evaluating a difference of the O. D. values between a first cycle and a second cycle of the development roller 120. The results are shown in Table. 3.

$$M=\delta\cdot p\cdot x \tag{1}$$

In Eq. (1), M is a deposited toner amount, δ is a specific gravity of the toner, p is a toner packing density, and x is a toner layer thickness.

$$p=\delta\cdot p\cdot q/m \tag{2}$$

In Eq. (2), ρ is a toner volume charge density, and q/m is a specific toner charge.

$$V_t=1/2(p\cdot x^2)/(\in_0\cdot\in_r) \tag{3}$$

In Eq. (3), $V_t$ is a toner layer potential, $\in_0$ is a dielectric constant in a vacuum, and $\in_r$ is a specific toner dielectric constant.

$$V_t=1/2(\delta\cdot p\cdot q/m\cdot x^2)/(\in_0\cdot\in_r) \tag{4}$$

$$q/m=(2\cdot\in_0\cdot\in_r\cdot V_t)/(x^2\cdot\delta\cdot p) \tag{5}$$

$$q/m=(2\cdot\in_0\cdot\in_r\cdot\delta\cdot p\cdot V_t)/M^2 \tag{6}$$

In the above equations, Eq. (4) is derived from Eqs. (2) and (3), while Eq. (5) is a variation of Eq. (4). Eq. (6) is formed by substitution of Eq. (1) into Eq. (5). According to these equations, the specific toner charges may be worked out from the deposited toner amounts if various properties of toner are known and the potential is revealed by the electrometer.

A description will be given of influences on the specific toner charges, fogging, and image retention exerted by the materials for the coating layer 128, with reference to Table

3.

TABLE 3

| Materials for coating layers | Specific toner charge q/m | Fogging on photosensitive body (O.D. value) | Image retention (Solid O.D. difference) |
|---|---|---|---|
| Silicon | −21.2 μC/g | 0.02 | 0.09 |
| Polyurethane | −16.3 μC/g | 0.06 | 0.05 |
| Polystyrene | −12.5 μC/g | 0.09 | 0.02 |
| Polyvinyl butyral | −11.8 μC/g | 0.12 | 0.02 |

As shown in Table 3, Silicon exhibits the lowest specific toner charge, and the lower the positive charge property is, the higher the specific toner charge is exhibited. Silicon exhibits the lowest level of fogging on the photosensitive body, and it turned out that the coating layer 128 made of silicon could form a high-quality image even if the toner was deteriorated by repeated printing operations. Further, the image retention in an early stage of printing occurred more in the coating layer made of silicon than in the coating layers made of any other materials, and least in the coating layer made of polystyrene and polyvinyl butyral.

Judging from the above results, the most suitable resins for the coating layers 126 and 128 of the development roller 120 were determined as shown in Table 4, in this experiment 1.

TABLE 4

| Coating layer | Materials for coating layers | Coating layer thickness |
|---|---|---|
| First coating layer 128 | Polystyrene | 1 through 2 μm |
| Second coating layer 126 | Silicon | about 10 μm |

As shown in Table 4, polystyrene was selected for the second coating layer 128. Polystyrene may reduce image retention in an early stage of printing, and thus most suitable for the coating layer forming an outermost periphery of the development roller 120. In addition, although silicon was selected for the first coating layer 126, this is because silicon has a higher charging capability to the toner than polystyrene, and is unlikely to produce a fog even after repeated printing operations. The layer thicknesses of the first and second coating layers 126 and 128 were determined by experimentally working out a relationship between the amount of resin that has been scraped away and the deteriorated condition of the toner.

Printing operation was experimentally repeated utilizing the development roller 120 having a structure described in Table 4. Images to be printed were character patterns, which made up 1% area of a sheet to be printed. The experiment was conducted at room temperature. The results are shown in Table 5. For the purpose of comparison, further experiments utilizing the conventional development roller including a single coating layer were conducted. Table 6 lists the experimental printing results where polystyrene was used as a coating layer for the development roller. Table 7 lists the experimental printing results where silicon was used as a coating layer for the development roller. The thickness of the coating layer for each embodiment was adjusted to 10 μm.

TABLE 5

| The number of paper printed | First few | 5,000 | 10,000 |
|---|---|---|---|
| Fogging on photosensitive body (O.D. value) | 0.01 | 0.02 | 0.03 |
| Image retention (Solid O.D. difference) | 0.02 | 0.02 | 0.01 |
| Specific toner charge (μC/g) | −15.4 | −17.2 | −16.3 |

TABLE 6

| The number of paper printed | First few | 5,000 | 10,000 |
|---|---|---|---|
| Fogging on photosensitive body (O.D. value) | 0.01 | 0.06 | 0.11 |
| Image retention (Solid O.D. difference) | 0.01 | 0.02 | 0.02 |
| Specific toner charge (μC/g) | −16.2 | −13.8 | −10.4 |

TABLE 7

| The number of paper printed | First few | 5,000 | 10,000 |
|---|---|---|---|
| Fogging on photosensitive body (O.D. value) | 0.01 | 0.03 | 0.03 |
| Image retention (Solid O.D. difference) | 0.10 | 0.02 | 0.02 |
| Specific toner charge (μC/g) | −21.2 | −16.1 | −14.9 |

According to Tables 5 through 7, it turned out that the development roller 120 in the present invention provided a specific toner charge with relatively high stability from the beginning until 10,000 sheets were printed. Particularly, the inventive development roller 120, unlike conventional development rollers, exhibited an increase of the specific toner charge. This was because the second coating 128 had been scraped away from the beginning until 5,000 sheets were printed, and the first coating layer 126 having a high charging capability came to the surface. Since the fogging and image retention were kept in an approximately constant level regardless of the number of sheets of paper printed, it turned out that the image retention and the fogging derived from the deterioration of toner were both repressed, and high-quality printed outputs were obtained. In contrast, in the printing experiments according to the conventional development roller, the fog due to repeated printing operations occurred even though the image retention was little as in Table 6, or the image retention occurred in an early stage of printing even though the occurrence of such fogging could be avoided as in Table 7.

[Experiment 2]

An image-formation experiment 2 was carried out using the image-forming device 200 according to the present invention. In the experiment 2, the concentrations of the charge control agents added to the resins making up the coating layers 126 and 128 were varied, and the same experiment was conducted as in the experiment 1. The other experimental conditions were, unless otherwise specified, determined to be the same as in the experiment 1. In the experiment 2 as well, the experimental conditions were maintained, and the image retention generated in an early stage of printing, and fogs generated after repeated printing operations were measured.

Approximately 20 μm of the coating layer made of polyurethane was applied to the development roller 120, and the amounts of the coating layer scraped away were measured. To the coating layer of polyurethane, a quaternary ammonium compound having positive charging properties was added as the charge control agent. The concentrations of the charge control agent were set between 0 and 5 wt %. The same measuring instrument was used as in the experiment 1. The results are shown in Table 8.

TABLE 8

| Concentrations of charge control agent | Amount scraped away |
|---|---|
| 0 wt % | 11.4 μm |
| 1 wt % | 12.2 μm |
| 3 wt % | 11.9 μm |
| 5 wt % | 13.8 μm |

The results shown in Table 8 would be an indicator for selecting a suitable layer thickness to which the coating layer is to be adjusted. As the charge control agent, triphenylmethane derivative, azo chroium complex, oxycarboxylic acid metal complex, azine compound, and the like are usable, though usable materials are not limited thereto, and a charge control agent having negative charging properties may be used depending upon a combination.

Next measured were specific toner charges on the development roller 120 when the outermost layer of the development roller 120 was formed with the sole coating layer selected among those listed in Table 8. Further, a fog generated on the photosensitive drum 210 and the image retention in an early stage of printing were measured as well. A calculating method, experimenting method, and evaluating method employed to determine the specific toner charges were the same as in the experiment 1. These results are shown in Table 9.

TABLE 9

| Concentrations of charge control agent | Specific toner charge q/m | Fogging on photosensitive body (O.D. value) | Image retention (Solid O.D. difference) |
|---|---|---|---|
| 0 wt % | −16.3 μC/g | 0.12 | 0.02 |
| 1 wt % | −17.5 μC/g | 0.08 | 0.03 |
| 3 wt % | −21.3 μC/g | 0.03 | 0.06 |
| 5 wt % | −21.5 μC/g | 0.02 | 0.09 |

According to Table 9, it turned out that the specific toner charge decreases as the concentration of the charge control agent increases. It was when the concentration was 3 wt % or more that little fogging appears regardless of the toner deterioration due to repeated printing operations. Least image retention occurred in an early stage of printing when the concentration was 0 wt % (no charge control agent was added).

Judging from the above results, the most suitable charge control agent for the coating layers 126 and 128 of the development roller 120 were determined as shown in Table 10, in this experiment 2.

TABLE 10

| Coating layer | Concentration of charge control agent | Coating layer thickness |
|---|---|---|
| First coating layer 128 | 0 wt % | 1 through 2 μm |
| Second coating layer 126 | 3 wt % | about 10 μm |

As shown in Table 10, the coating layer having the charge control agent the concentration of which is 0 wt %, which may produce the least image retention in an early stage of printing, was selected as the second coating layer 128 (outermost layer). The coating layer having the charge control agent the concentration of which is 3 wt % was selected as the first coating layer 126, and this is because the instant coating layer is not likely to produce a fog even after repeated printing operations. The layer thicknesses of the first and second coating layers 126 and 128 were experimentally determined from a relationship between the amount of each resin scraped away and the deteriorated conditions of toner.

Printing operation was experimentally repeated utilizing the development roller 120 having a structure described in Table 10. Images to be printed were character patterns, which made up 1% area of a sheet to be printed. The experiment was conducted at room temperature. The results are shown in Table 11.

TABLE 11

| The number of paper printed | First few | 5,000 | 10,000 |
|---|---|---|---|
| Fogging on photosensitive body (O.D. value) | 0.01 | 0.02 | 0.03 |
| Image retention (Solid O.D. difference) | 0.02 | 0.02 | 0.01 |
| Specific toner charge (μC/g) | −17.8 | −18.9 | −17.2 |

As shown in Table 11, the specific toner charge was relatively stable from the beginning until 10,000 sheets were printed according to the inventive development roller 120. Since the fogging and image retention were kept in an approximately constant level regardless of the number of sheets of paper printed, it turned out that the image retention and the fogging derived from the deterioration of toner were both repressed, and a high-quality printed outputs were obtained. In the experiment 2, a polyurethane resin was exemplarily used, but usable materials are not limited thereto.

According to the experiment 1 and the experiment 2, it turned out that the development roller 120 having the coating layers 126 and 128 that differs in charging capability to toner from each other may repress both fogging and image retention, and form a high-quality image. However, the same effects may be obtained not only using the development roller 120, but also from a layered structure of the blade 130 as shown in FIG. 4. To be more specific, the blade 130 is provided with a first coating layer 134 and a second coating layer 136 so that the charging capability of the first coating layer 134 is larger than that of the second coating layer 136, and the second coating layer 136 is a contact surface with toner T. Thus, the second coating layer 136 of the blade 130 is scraped away, and the first coating layer 134 comes to the surface, so that the charging capability of the contact surface to the toner T varies, thereby producing the same effects as the development roller 120 has. Provision of such layered structures as shown in FIGS. 3 and 4 in both the development roller 120 and the blade 130 would also produce the same effects.

Judging from the experiments 1 and 2 as described above, the development roller, blade, development device and image forming device having the development roller and/or the blade according to the present invention serve to prevent the decrease of toner charge amount as deemed to be a conventional disadvantage, and to stabilize the toner charge amount regardless of the number of printed sheets. Accordingly, the present invention may reduce the occurrence of the image retention in an early stage of printing when only a few numbers of sheets have been printed, and the occurrence of a fog due to deterioration of toner T, thereby forming a high-quality image irrespective of the number of printed sheets.

Although the preferred embodiments of the present invention have been described above, various modifications and changes may be made in the present invention without departing from the spirit and scope thereof. For instance, it is to be understood that the scope of application of the present invention is not limited to the contact-type development process using nonmagnetic monocomponent developing agent, but the present application is applicable to the noncontact-type development process using nonmagnetic monocomponent developing agent. Furthermore, the present invention is also applicable to the nonmagnetic dual-component developing agent, and the magnetic developing agent.

As described above, the inventive development roller, blade, and development device and image-forming device having the development roller and/or the blade may make the charge amount of toner stable, irrespective of the number of paper printed. Accordingly the occurrence of fogs due to deterioration of the toner T may be repressed, thus a high-quality image may be formed irrespective of the number of paper printed.

What is claimed is:

1. A development roller comprising:

a shaft;

a base material that coats a periphery of the shaft, and is made of a resistance body; and a layered coating provided on a periphery of the base material, wherein the layered coating includes two or more layers, and a coating layer provided inside an outermost coating layer has a higher charging capability to a developing agent than at least the outermost coating layer.

2. A development roller according to claim 1, wherein the outermost coating layer and the coating layer inside the outermost coating layer are made of a material selected from the group consisting of silicon, polyurethane, polystyrene, polyvinyl butyral, polymethylmethacrylate, nylon 66 (polyamide), polyester, polyethylene terephthalate, polyethylene, polycarbonate, and epoxy resin; and wherein the coating layer inside the outermost coating layer has a higher charging capability than the outermost coating layer.

3. A development roller comprising:

a shaft;

a base material that coats a periphery of the shaft, and is made of a resistance body; and a layered coating that is provided on a periphery of the base material, and includes two or more layers, and a coating layer provided inside an outermost coating layer has a higher charging capability to a developing agent than at least the outermost coating layer, wherein the coating layer inside the outermost coating layer is made of silicon, and the outermost coating layer is made of polystryene.

4. A development roller comprising:

a shaft;

a base material that coats a periphery of the shaft, and is made of a resistance body; and a layered coating that is provided on a periphery of the base material, and includes two or more coating layers, and a coating layer provided inside an outermost coating layer has a higher charging capability to a developing agent than at least the outermost coating layer, wherein the coating layer inside the outermost coating layer has a layer thickness of about 10 $\mu$m, and is made of silicon, wherein the outermost coating layer has a layer thickness of 1 through 2 $\mu$m, and is made of polystyrene.

5. A development roller comprising:

a shaft;

a base material that coats a periphery of the shaft, and is made of a resistance body; and a layered coating provided on a periphery of the base material, wherein the layered coating includes:

a first coating layer; and a second coating layer located outside the first coating layer, a concentration of a charge control agent added to the second coating layer being lower than that added to the first coating layer.

6. A development roller according to claim 5, wherein the charge control agents added to the first coating layer and the second coating layer are made of a material selected from the group consisting of triphenylmethane derivative, azo chroium complex, oxycarboxylic acid metal complex, and azine compound, wherein the concentration of the charge control agent added to the second coating layer is lower than that added to the first coating layer.

7. A development roller comprising:

a shaft;

a base material that coats a periphery of the shaft, and is made of a resistance body; and a layered coating that is provided on a periphery of the base material, and includes a first coating layer, and a second coating layer located outside the first coating layer, a concentration of a charge control agent added to the second coating layer being lower than that added to the first coating layer, wherein the concentration of the charge control agent added to the first coating layer is 3 wt %, and the concentration of the charge control agent added to the second coating layer is 0 wt %.

8. A development roller comprising:

a shaft;

a base material that coats a periphery of the shaft, and is made of a resistance body; and a layered coating that provided on a periphery of the base material, and includes a first coating layer, and a second coating layer located outside the first coating layer, a concentration of a charge control agent added to the second coating layer being lower than that added to the first coating layer, wherein the concentration of the charge control agent added to the first coating layer which has a layer thickness of about 10 $\mu$m is 3 wt %, and the concentration of the charge control agent added to the second coating layer which has a layer thickness of 1 through 2 $\mu$m and is 0 wt %.

9. A blade comprising:

a base material made of metal and shaped like a plate; and a layered coating provided on one surface of the base material, the surface being in contact with a development roller, wherein the layered coating includes two or more layers, and a coating layer provided at least inside an outermost coating layer has a higher charging capability to a developing agent than the outermost coating layer.

10. A development device comprising:

a development roller; and a blade that is brought into contact with the development roller, and forms a toner layer at a predetermined layer thickness, wherein the development roller comprises:

a shaft;

a base material that coats a periphery of the shaft, and is made of a resistance body; and a layered coating provided on a periphery of the base material, wherein the layered coating includes two or more layers, and a coating layer provided at least inside an outermost coating layer has a higher charging capability to a developing agent than the outermost coating layer.

11. A development device comprising:

a development roller; and a blade that is brought into contact with the development roller, and forms a toner layer at a predetermined layer thickness, wherein the blade comprises:

a base material made of metal and shaped like a plate; and a layered coating provided on one surface of the base material, the surface being in contact with said development roller, wherein the layered coating includes two or more layers, and a coating layer provided at least inside an outermost coating layer has a higher charging capability to a developing agent than the outermost coating layer.

12. An image-forming device comprising:

a photosensitive body;

a charger that charges the photosensitive body;

an exposure part that exposes the photosensitive body charged by the charger to light, and forms an electrostatic latent image;

a development device that develops the photosensitive body exposed to light, and visualizes the electrostatic latent image into a toner image; and a transfer part that transfers the toner image onto a recordable medium, wherein the development device comprises:

a development roller; and a blade that is brought into contact with the development roller, and forms a toner layer at a predetermined layer thickness, wherein the development roller comprises:

a shaft;

a base material that coats a periphery of the shaft, and is made of a resistance body; and a layered coating provided on a periphery of the base material, wherein the layered coating includes two or more layers, and a coating layer provided at least inside an outermost coating layer has a higher charging capability to a developing agent than the outermost coating layer.

* * * * *